US007828141B2

(12) United States Patent
Epp et al.

(10) Patent No.: US 7,828,141 B2
(45) Date of Patent: Nov. 9, 2010

(54) CONTAINER CLOSURE HAVING A CAPSULE INSIDE IT

(75) Inventors: René Epp, Alpnach-Dorf (CH); Daniel Teicher, Immensee (CH); Wolfgang Heukamp, Finnentrop (DE); Martin Albers, Sudern (DE)

(73) Assignee: Georg Menshen GmbH & Co., KG, Finnentrop (DE)

( * ) Notice: Subject to any disclaimer, the term of this patent is extended or adjusted under 35 U.S.C. 154(b) by 0 days.

(21) Appl. No.: 12/296,964

(22) PCT Filed: Feb. 15, 2007

(86) PCT No.: PCT/EP2007/001303

§ 371 (c)(1),
(2), (4) Date: Oct. 13, 2008

(87) PCT Pub. No.: WO2007/118539

PCT Pub. Date: Oct. 25, 2007

(65) Prior Publication Data

US 2009/0261000 A1 Oct. 22, 2009

(30) Foreign Application Priority Data

Apr. 12, 2006 (DE) ..... 10 2006 017 605

(51) Int. Cl.
*B65D 25/08* (2006.01)

(52) U.S. Cl. ..... 206/222; 206/219; 206/220

(58) Field of Classification Search ..... 206/222, 206/219, 220, 221, 568; 215/6, 10, DIG. 8, 215/228; 222/81, 83, 145.5, 145.6; 220/277, 220/278

See application file for complete search history.

(56) References Cited

U.S. PATENT DOCUMENTS 5,927,549 A * 7/1999 Wood ..... 222/83
2006/0254935 A1* 11/2006 Pearce et al. ..... 206/219

FOREIGN PATENT DOCUMENTS

WO WO-2005073098 8/2005

* cited by examiner

*Primary Examiner*—Mickey Yu
*Assistant Examiner*—Rafael Ortiz
(74) *Attorney, Agent, or Firm*—Andrew Wilford

(57) ABSTRACT

The invention relates to a closure for a container having an adapter part which can be fastened to the container connecting piece forming the container opening and on the external thread of which a hood-shaped part is screwed which forms the upper removal opening, wherein a capsule which is filled with an active substance and the contents of which can be moved into the interior of the container lies on the upper edge of the container connecting piece, wherein the capsule can be cut open by blades which protrude on a blade ring which can be rotated by rotation of the hood-like part and can be moved downwards, wherein the blade ring can be moved downwards during a first rotational range of the hood-shaped part until the blades stab into the capsule, and wherein the blade ring can be rotated by the hood-shaped part during the subsequent second rotational range of the hood-shaped part, in particular without a further movement downwards.

18 Claims, 2 Drawing Sheets

CONTAINER CLOSURE HAVING A CAPSULE INSIDE IT

CROSS REFERENCE TO RELATED APPLICATIONS

This application is the US national phase of PCT application PCT/EP2007/001303, filed 15 Feb. 2007, published 25 Oct. 2007 as WO 2007/118539, and claiming the priority of German patent application 102006017705.7 itself filed 12 Apr. 2006, whose entire disclosures are herewith incorporated by reference.

FIELD OF THE INVENTION

The invention relates to a closure for a container, with an adapter part which can be fastened onto the container nozzle forming the container opening and onto the external thread of which a hood-shaped part is screwed, the part forming the upper removal opening, wherein a capsule which is filled with an active compound rests on the upper edge of the container nozzle and the contents of which can be brought into the interior of the container.

BACKGROUND OF THE INVENTION

It is known above a container nozzle to arrange a capsule which is filled with active compounds and the contents of which are brought into the container liquid before the container is emptied. If the contents of the capsule are in tablet form, then it has been shown that the tablet does not always pass into the liquid, but rather the foil base of the capsule prevents the tablet from departing fully from the capsule. The technical structure of the parts of the closure that are intended for placing the contents of the capsule into the container is also complicated, costly and not of adequate and reliable operation.

OBJECT OF THE INVENTION

It is the object of the invention to improve a closure of the type mentioned at the beginning in such a manner that, while the structure and handling is simple, the contents of the capsule always reliably reach the interior of the container. It is also the object of the invention to simplify the movement sequences within the closure and to reduce the movement distance of the hood-shaped part and therefore the dimensions vertically.

SUMMARY OF THE INVENTION

These objects are achieved according to the invention in that the capsule can be cut open by blades which protrude on a blade ring which can be rotated by rotation of the hood-shaped part and can be moved downward, in that, during a first rotational range of the hood-shaped part, the blade ring can be moved downward until the blades stab into the capsule, and in that, during the subsequent, second rotational range of the hood-shaped part, the blade ring can be rotated by the hood-shaped part, in particular without a further movement downward.

By means of a structure of this type, the stabbing and cutting functions are separated from each other, and it is ensured that, while the overall height is small and the construction is simple, the contents of the capsule always pass into the interior of the container.

Reliable opening and removal are achieved in that the upper and lower foils of the capsule can be severed by the blades.

It is preferably proposed that, during the first rotational range, a spring arranged in the blade ring is tensioned and exerts a spring force on the capsule. The spring thereby ensures that the contents of the capsule reliably emerge.

In this connection, it is particularly advantageous if, in the lower position of the blade ring, the contents of the capsule, in particular a tablet, can be pressed by the spring into the container, and the cut sections of the foils can be moved out of the path of the container fluid.

A reduction in the number of parts while maintaining a reliable operation is provided if the spring is integrally formed on the blade ring. It is also advantageous if, during the first rotational range, the hood-shaped part tears off a tamper-proof ring from the adapter part.

A particularly simple structure and handling are achieved if the removal channel from the opening of the container nozzle as far as the upper removal opening of the hood-shaped part runs through the open capsule.

It is preferably proposed that the blades can be stabbed into the capsule and into a foil, in particular a sealing foil, closing the container opening. A simple, secure structure is provided if the hood-shaped part and the blade ring are designed as a single part. The container is reliably prevented from running out to the outside after the capsule is cut open if the inside of the adapter part has a sealing cone which bears against the outside of the container nozzle in order to form a sealing point.

BRIEF DESCRIPTION OF THE DRAWING

An embodiment of the invention is illustrated in axial steps in the drawings and is described in more detail below. In the drawings.

SPECIFIC DESCRIPTION

Figure 1:
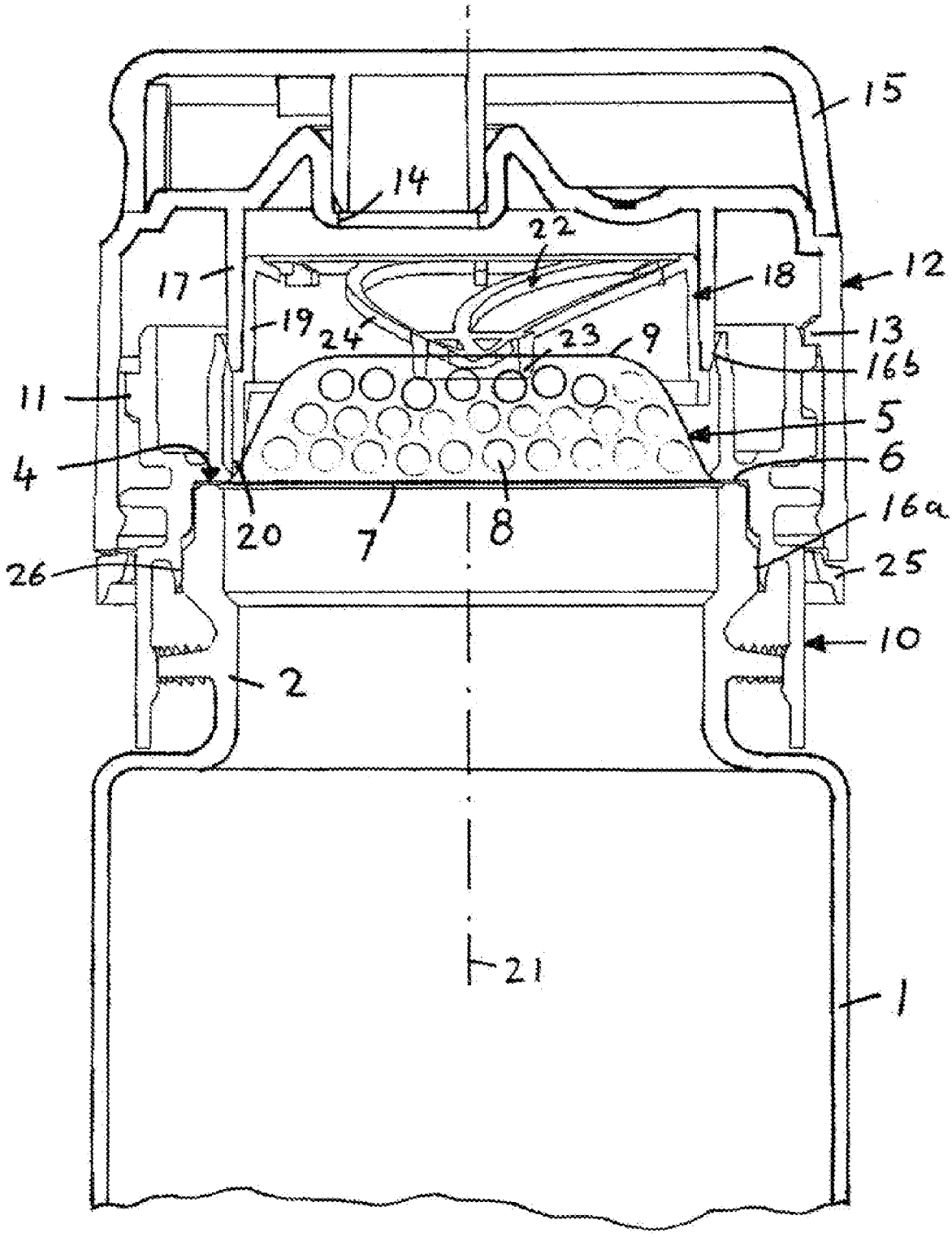
FIG. 1 shows the closure before its actuation.

A container 1 has an upper, substantially cylindrical nozzle 2 which forms an upper, round opening 3 through which the liquid contents of the container can be removed. The outer edge of a capsule 5 is fastened to, in particular welded or sealed onto, the upper circular edge 4 of the nozzle opening 3. In this case, the outer capsule edge 6 is formed by the flat lower foil 7 of the capsule. A tablet rests on the lower foil 7, or small particles 8, in particular in spherical form, are located as the active compound in the capsule 5 and are covered by the upper foil 9 of the capsule 5, the outer edge of which is fastened in a sealed manner to the outer edge of the lower foil 7. The complete capsule 5 may also be placed onto a container or bottle opening which is sealed after being filled. In this case, three foils then have to be cut through.

An adapter part 10 is fastened to, in particular clamped or screwed onto, the outside of the container nozzle 2. In this connection, the inside of the adapter part 10 has a sealing cone 26 which bears against the outside of the container nozzle 2 in order to form a sealing point 16*a* and the axially rotationally symmetrical part extends upward beyond the container nozzle 2 and protrudes inward, in particular in a clamping manner, over the nozzle edge 4 and the outer edge of the capsule 5. On the outside, the adapter part 10 has an external thread 11, onto the outside of which a hood-shaped part 12 is screwed by means of its internal thread 13. FIG. 1 illustrates the hood-shaped part 12 in an upper screwing position.

The axially rotationally symmetrical, hood-shaped part 12 has an upper removal opening 14 which is covered by a closure cap 15 which opens the opening 14 after being pulled upward.

A downwardly protruding bush 17, in which a blade ring 18 is mounted by means of its cylindrical outer ring 19, is integrally formed coaxially on the inside of the hood-shaped part 12. Individual, integrally formed blades 20 protrude downward on the lower side of the outer ring 19 and can be used to sever the upper foil 9 and the lower foil 7 of the capsule 5.

The parts 1, 2, 5, 10, 12, 15 and 18 are rotationally symmetrical with respect to the vertical axis 21.

A spring 22 is integrally formed in the interior of the blade ring 18 and has a central, lower plate 23 which is integrally formed on the blade ring 18 via spring arms 24. The plate 23 rests here on the upper side of the capsule 5, the plate 23 only exerting a small pressure on the capsule 5 in the upper position of the hood-shaped part 12 and of the blade ring 18.

Figure 2:
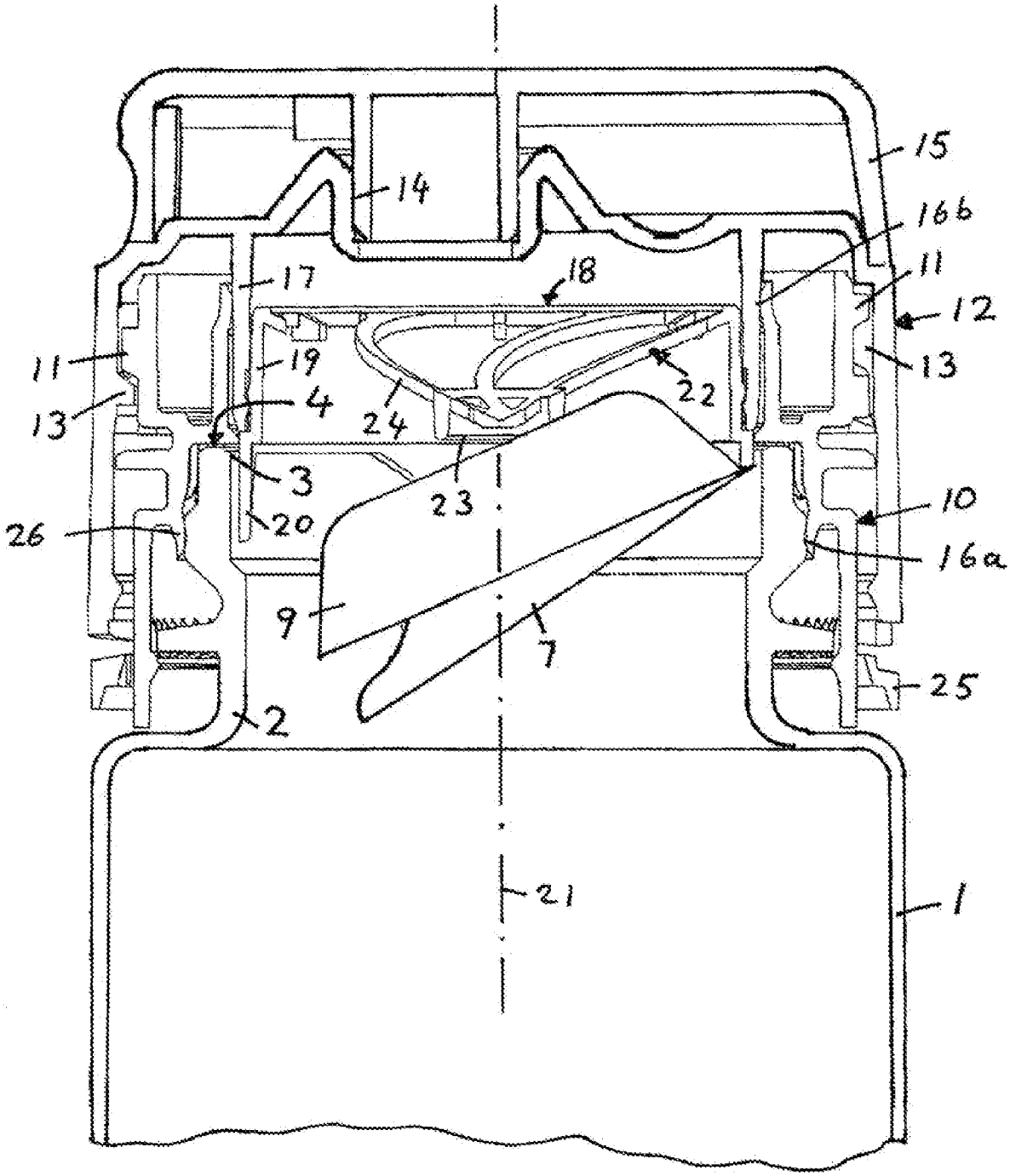
FIG. 2 shows the closure after its actuation.

If the hood-shaped part 12 is rotated by hand out of the position illustrated in FIG. 1 about the axis 21, then the part 12 moves downward into the position illustrated in FIG. 2. During this movement, the lower edge of the part 12 strikes against a tamper-proof ring 25 integrally formed on the outside of the adapter part 10 and breaks it off when the part 12 is moved downward. During the downward movement of the part 12, it carries along the blade ring 18, and the blade ring 18 uses its blades 20 to penetrate the foils 7 and 9 during the first movement and also the sealing foil, if present, of the container opening and, during the penetration, the blade ring 18 in itself not rotating further together with the part 12, since, during this first rotational range of the hood-shaped part 2, there is a rotational clearance between the parts 12 and 18. Only during the further rotation of the hood-shaped part 12 and therefore during the second rotational range does at least one stop on the inside of the bush 17 reach a counterstop of the blade ring 18 such that the part 12 rotationally entrains the ring 18, and therefore the blades 20 cut through the foils 7 and 9 of the capsule 5 completely all the way around and/or for the most part.

As an alternative, the blade 20 may be fastened in a play-free manner to the hood-shaped part 12. This results in a spiral movement determined by the pitch of the thread 11, downward. The stabbing, cutting and pressing functions merge smoothly and uniformly into one another.

By a design on the hood-shaped part 12 of the thread with different pitches connected consecutively and having segments running therein, the functions can be broken down into a more vertical movement during the stabbing, a pure rotational movement during the cutting, and into a more vertical movement for pressing.

With the movement downward of the blade ring 18 through the hood-shaped part 12, the spring arms 24 of the spring 22 are tensioned such that the plate 23 exerts a considerable pressure on the upper side of the capsule 5. This results, after the foils 7 and 9 have been cut through, in the contents of the capsule, in particular the tablet or particles 8, being pressed downward into the container nozzle 2 and therefore into the container 1 in order to dispense the active compound into the liquid of the container.

Reliable input of the contents of the capsule, in particular of the tablet 8, into the container is ensured in that the lower film 7 is completely cut through all the way around apart from a small residual region and therefore forms a flap which projects steeply downward into the nozzle 2 and therefore ensures that it is not in the way of the active compound, in particular of the tablet 8.

On the outside diameter of the nozzle 2, there is a seal **16*a* between the nozzle 2 and the adapter part 10. There is a second sealing region 16*b* between the adapter part 10 and hood-shaped part 12. The seals 16*a* and 16*b* ensure that the product does not run out as soon as the foil has been pierced. The bush 17 moves within the seal 16*b*** during the rotation movement downward.

After the active compound or the active compounds has or have passed into the liquid of the container, the closure forms an open removal passage from the interior of the container as far as the upper removal opening 14 through the capsule 5.

It is structurally also possible to manufacture the blade ring 18 together with the spring 22 and the hood-shaped part 12 as a single part.

The invention claimed is:

1. A closure for a container having a nozzle, the closure comprising:

an adapter part having an external thread and that can be fastened onto the container nozzle forming a container opening;

a hood-shaped part screwed onto the external thread of the adapter part and forming an upper removal opening;

a capsule adapted to rest on an upper edge of the container nozzle and holding an active compound that can be brought into an interior of the container; and blades that can cut open the capsule and that project from a blade ring which can be rotated by rotation of the hood-shaped part and can be moved downward, wherein during a first rotational range of the hood-shaped part, the blade ring can be moved downward until the blades stab into the capsule and a spring in the blade ring can be tensioned to exert a spring pressure on the capsule, and during a subsequent, second rotational range of the hood-shaped part, the blade ring can be rotated by the hood-shaped part generally without a further movement downward.

2. The closure as claimed in claim 1 wherein an upper and a lower foil of the capsule can be severed by the blades.

3. The closure as claimed in claim 2 wherein, in a lower position of the blade ring, the active compound can be pressed by the spring into the container and cut sections of the foils can be moved out of the path of a liquid in the container.

4. The closure as claimed in claim 1 wherein the spring is integrally formed on the blade ring.

5. The closure as claimed in claim 1 wherein, during the first rotational range, a tamper-proof ring can be torn off the adapter part by the hood-shaped part.

6. The closure as claimed in claim 1 wherein a removal passage extending from the container opening to the upper removal opening of the hood-shaped part runs through the capsule when cut open.

7. The closure as claimed in claim 1 wherein the blades can be stabbed into the capsule and into a sealing foil closing the container opening.

8. The closure as claimed in claim 1 wherein the hood-shaped part and the blade ring are designed as a single part.

9. The closure as claimed in claim 1 wherein the adapter part has an inner sealing cone which bears externally against the container nozzle in order to form a sealing point.

10. In combination with a liquid-holding container having an externally threaded neck forming an upwardly open mouth, a closure comprising:

an adapter ring threaded externally onto the neck;

a cup-shaped cap screwed onto the adapter ring and normally upwardly closing the mouth;

a frangible capsule containing an active ingredient miscible with the liquid in the container and resting on the mouth underneath the cap;

a blade ring between the adapter ring and the capsule and having at least one blade projecting downward toward the capsule; and means including formations between the cap and the adapter ring for, at an initial stage of relative rotation of the cap and the container in a predetermined rotational sense about an axis, stabbing the blade axially into the capsule without substantial angular movement about the axis of the blade and thereafter, during a subsequent stage of relative rotation of the cap and the container in the predetermined rotational sense, shifting the blade mainly angularly relative to the capsule and the container and thereby cutting the capsule annularly and freeing the active ingredient to drop into the liquid in the container; and a spring on the blade ring above the capsule positioned to be loaded during the first stage and to press forcibly downward on the capsule during the subsequent stage.

11. The combination defined in claim 10 wherein the capsule has upper and lower foils containing the active ingredient, the blade stabbing through both foils in the initial stage.

12. The combination defined in claim 10 wherein after completion of the subsequent stage the spring extends down past where the capsule at the start of the first stage.

13. The combination defined in claim 10 wherein the spring is unitarily formed with the blade ring.

14. The combination defined in claim 10, further comprising:

a tamper-indicating ring on the neck below the cap and having a frangible web connecting itself to the adapter ring and positioned to be pushed away from the adapter ring with rupturing of the web on downward movement of the cap during the subsequent stage.

15. The combination defined in claim 10 wherein after annular severing of the capsule by the blade during the subsequent stage, a residual edge of the capsule trapped between the adapter ring and neck forms an upwardly open passage through which liquid can exit the container.

16. The combination defined in claim 10, further comprising:

a sealing foil engaged over an upper rim of the neck underneath the capsule, the blade stabbing through the sealing foil also during the initial stage.

17. The combination defined in claim 10 wherein the adapter has a sealing cone bearing externally in sealing engagement with the neck.

18. The combination defined in claim 10 wherein the blade ring is angularly coupled to the cap, the formations including generally zero-pitch screwthread formations between the cap and blade ring that are mutually engaged during the subsequent stage and greater-than-zero-pitch screwthread formations that form a continuation of the zero-pitch formations and that are mutually engaged during the initial stage.

* * * * *